US008353188B1

(12) United States Patent
Byerly et al.

(10) Patent No.: US 8,353,188 B1
(45) Date of Patent: Jan. 15, 2013

(54) CHILDPROOF DEADBOLT

(76) Inventors: Larry Byerly, Plantation, FL (US); Thomas Hochbrueckner, Plantation, FL (US)

( * ) Notice: Subject to any disclaimer, the term of this patent is extended or adjusted under 35 U.S.C. 154(b) by 651 days.

(21) Appl. No.: 12/482,051

(22) Filed: Jun. 10, 2009

(51) Int. Cl.
*E05B 55/04* (2006.01)

(52) U.S. Cl. ..... 70/467; 70/210; 70/416; 292/DIG. 37

(58) Field of Classification Search ..... 70/210, 70/215, 416, 467, 468, 471; 292/177, 179, 292/180, 182, DIG. 26, DIG. 37
See application file for complete search history.

(56) References Cited

U.S. PATENT DOCUMENTS

| | | | | |
|---|---|---|---|---|
| 729,151 | A | 5/1903 | Clough | |
| 1,956,388 | A * | 4/1934 | Kalina | 70/416 |
| 3,747,377 | A | 7/1973 | Van Deudekom | |
| 4,055,361 | A * | 10/1977 | Moses | 292/359 |
| 4,794,768 | A | 1/1989 | Moser et al. | |
| 5,000,498 | A | 3/1991 | Upchurch | |
| 5,072,976 | A * | 12/1991 | Meszaros | 292/207 |
| 5,154,455 | A | 10/1992 | Awalt, Jr. | |
| 5,199,285 | A | 4/1993 | Lin | |
| 5,689,984 | A * | 11/1997 | Diculescu et al. | 70/416 |
| 5,901,590 | A | 5/1999 | Lai | |
| 5,934,122 | A * | 8/1999 | Edwards et al. | 70/416 |
| D433,920 | S | 11/2000 | Chang | |
| 6,145,358 | A * | 11/2000 | Wu | 70/467 |
| 6,742,369 | B1 * | 6/2004 | Veillette | 70/416 |
| 6,769,278 | B1 * | 8/2004 | Chang | 70/134 |
| 7,264,285 | B1 | 9/2007 | Ross | |
| D563,764 | S | 3/2008 | Hacker | |
| 7,530,245 | B2 * | 5/2009 | Fan | 70/134 |
| 7,712,343 | B2 * | 5/2010 | Smith et al. | 70/467 |
| 7,802,828 | B2 * | 9/2010 | Hopkins et al. | 292/288 |

* cited by examiner

*Primary Examiner* — Christopher Boswell

(57) ABSTRACT

The childproof deadbolt includes a standard deadbolt with a thumb turn wherein a childproofing mechanism is integrated into the design of the thumb turn. The childproofing mechanism consists of at least one spring-loaded push button that when depressed engages an internal gear in rotational connection with the deadbolt. Absent depression of said push button the thumb turn is free to rotate independent of the internal gear and the deadbolt.

13 Claims, 7 Drawing Sheets

CHILDPROOF DEADBOLT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of deadbolts, more specifically, a childproof deadbolt that requires an amount of dexterity of the fingers to operate the deadbolt.

B. Discussion of the Prior Art

As a preliminary note, it should be stated that there is an ample amount of prior art that deals with deadbolts. As will be discussed immediately below, no prior art discloses a deadbolt having a thumb turn with push button childproofing means integrated therein.

The Lin Patent (U.S. Pat. No. 5,199,285) discloses a locking device for an auxiliary lock comprising of a safety button able to be pressed in and a rotating ring to be rotated to actuate the dead lock to be extended for locking the lock. However, the dead lock does not have a typical thumb turn that has push button childproofing means.

The Lai Patent (U.S. Pat. No. 5,901,590) discloses an interior door lock assembly with a safety device. Again, the door lock assembly does not have a thumb turn with a push button to operate the thumb lock as a childproofing means.

The Van Deudekom Patent (U.S. Pat. No. 3,747,377) discloses a push-button door locking assembly. However, the push-button door locking assembly does not resemble a thumb turn for a dead bolt, nor does it provide a childproofing measure.

The Flora Patent (U.S. Pat. No. 729,151) discloses a doorknob lock that has two buttons that must be pushed to turn the knob. However, the push buttons must be depressed in order for the handle to turn, as opposed to a thumb turn that can freely rotate independent of the deadbolt but also includes an internal gear that operates the deadbolt upon depressing the push buttons.

The Awalt, Jr. Patent (U.S. Pat. No. 5,154,455) discloses a deadbolt lock having a U-shaped squeeze operated sliding bolt. However, the sliding bolt does not resemble a deadbolt with a thumb turn having childproofing means therein.

The Ross Patent (U.S. Pat. No. 7,264,285) discloses a dead-bolt lock safety latch for preventing unauthorized unlocking of a dead-bolt lock with a key or lock picking tools. However, the safety latch does not prevent a child from operating a thumb turn of a deadbolt via childproofing means.

The Upchurch Patent (U.S. Pat. No. 5,000,498) discloses an interior deadbolt knob fastening apparatus. However, the deadbolt thumb turn fastening apparatus does not use spring-loaded pins that depress to operate a gear in direct rotational movement with the deadbolt, but rather restricts rotational movement of the thumb turn along the exterior of the thumb turn.

The Moser et al. Patent (U.S. Pat. No. 4,794,768) discloses a push button combination lock type gas cap and actuator employed therein. However, the push button combination lock does not operate a deadbolt or act as a childproofing measure against rotation of a thumb turn by a child.

While the above-described devices fulfill their respective and particular objects and requirements, they do not describe a deadbolt with a child proofing measure integrated into the design of the thumb turn. In this regard, the childproof deadbolt departs from the conventional concepts and designs of the prior art.

SUMMARY OF THE INVENTION

The childproof deadbolt includes a standard deadbolt with a thumb turn wherein a childproofing mechanism is integrated into the design of the thumb turn. The childproofing mechanism consists of at least one spring-loaded push button that when depressed engages an internal gear in rotational connection with the deadbolt. Absent depression of said push button the thumb turn is free to rotate independent of the internal gear and the deadbolt.

An object of the invention is to provide a thumb turn styled deadbolt with a childproofing mechanism integrated in the design of the thumb turn such that a child cannot operate the deadbolt.

A further object of the invention is to provide a thumb turn with a childproofing mechanism that requires a level of dexterity and intellect sufficient to dissociate operation by an adult and from a child.

These together with additional objects, features and advantages of the childproof deadbolt will be readily apparent to those of ordinary skill in the art upon reading the following detailed description of presently preferred, but nonetheless illustrative, embodiments of the childproof deadbolt when taken in conjunction with the accompanying drawings.

In this respect, before explaining the current embodiments of the childproof deadbolt in detail, it is to be understood that the childproof deadbolt is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the childproof deadbolt. It is therefore important that the claims be regarded as including such equivalent construction insofar as they do not depart from the spirit and scope of the childproof deadbolt. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
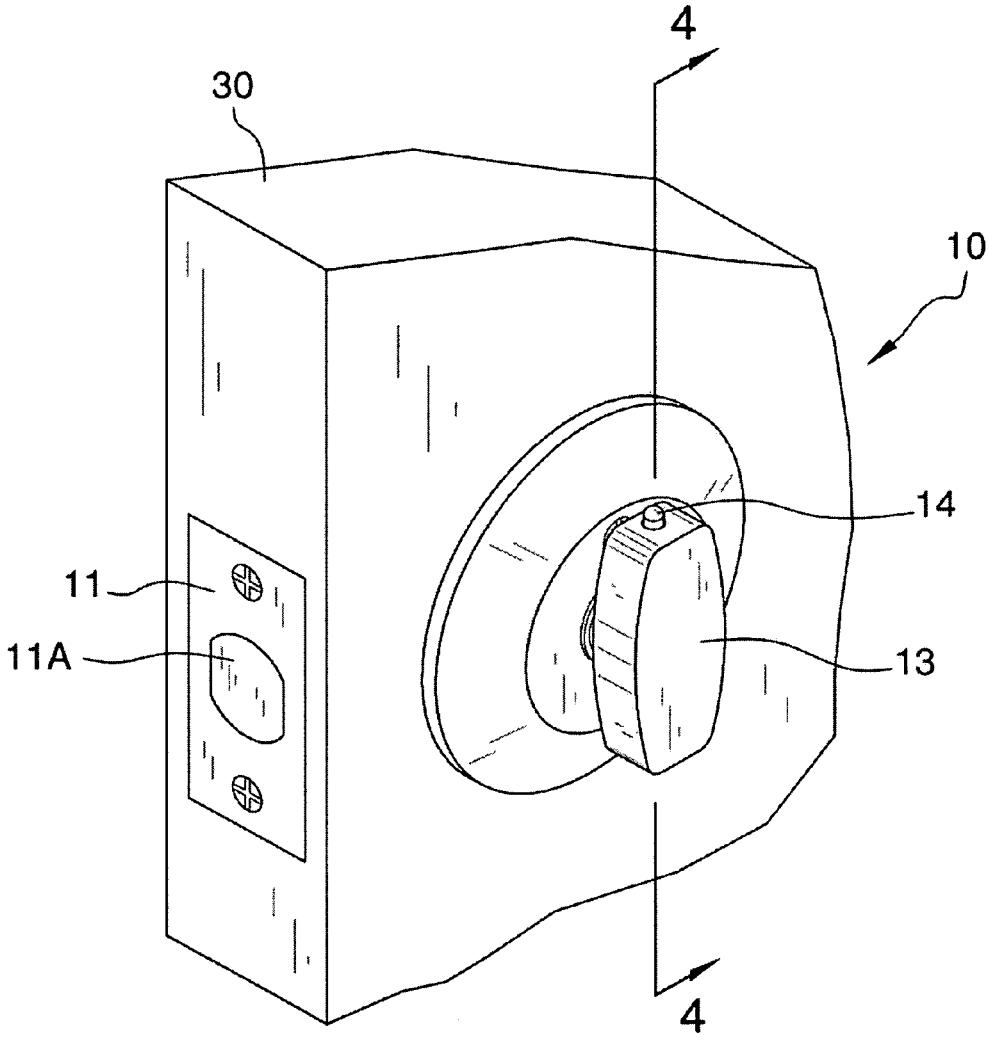
FIG. 1 illustrates a front, isometric view of the childproof deadbolt installed on a door.
Figure 2:
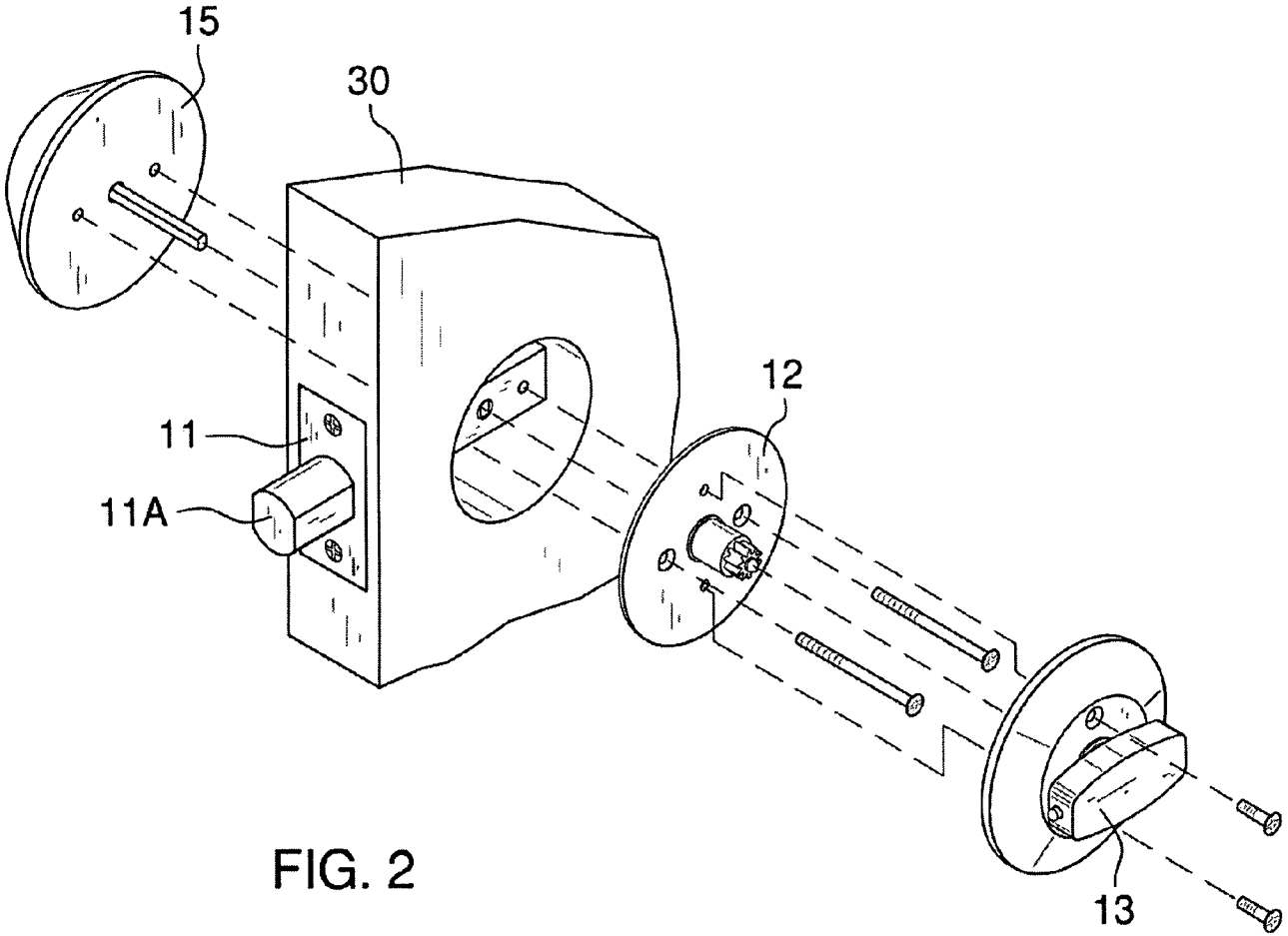
FIG. 2 illustrates a front, exploded view of the various components of the childproof deadbolt.
Figure 3:
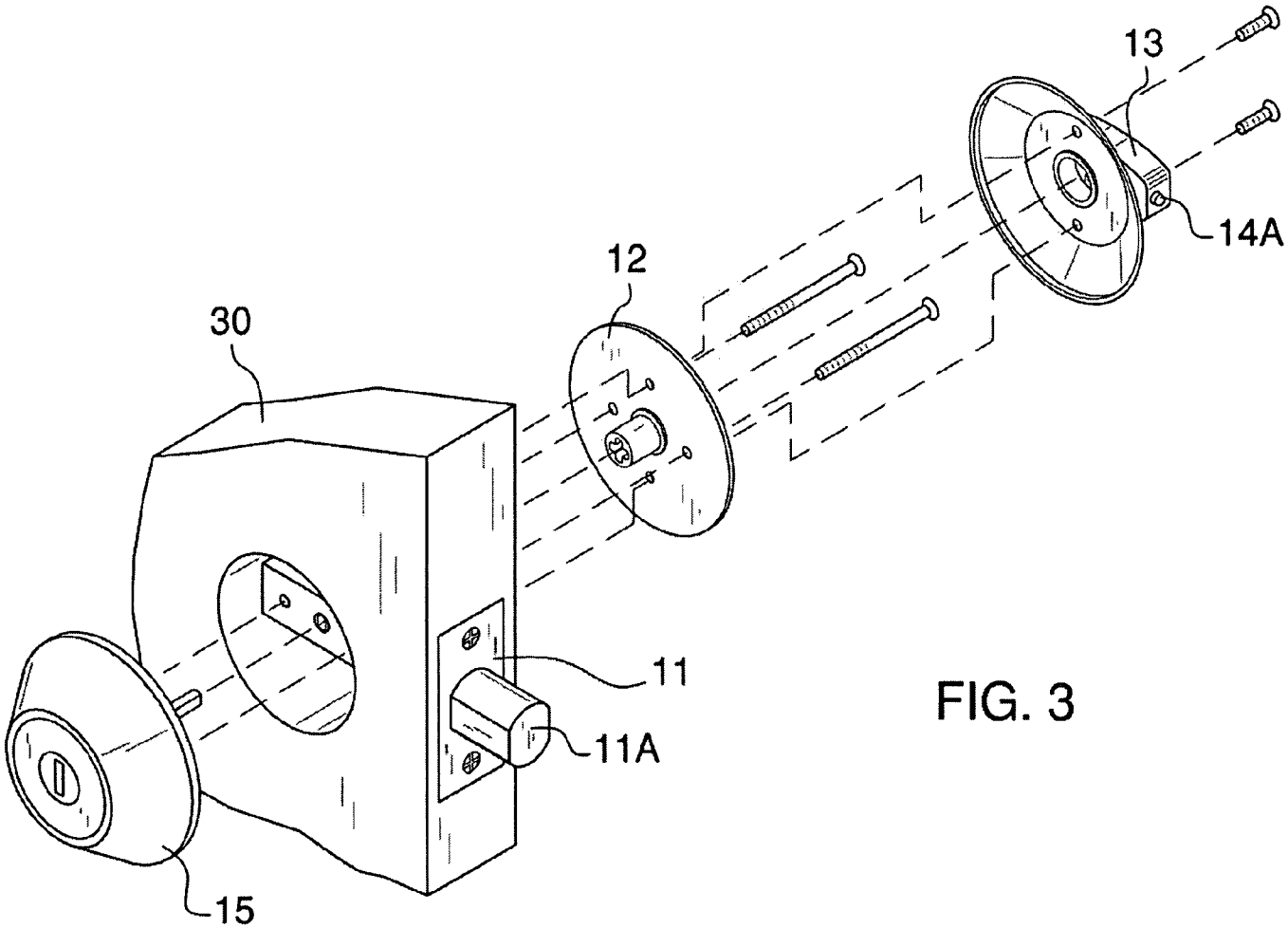
FIG. 3 illustrates a rear, exploded view of the various components of the childproof deadbolt.

Detailed reference will now be made to the preferred embodiment of the present invention, examples of which are illustrated in FIGS. 1-6. A childproof deadbolt (hereinafter invention) 10 includes a deadbolt assembly 11, internal gear 12, thumb turn 13, childproofing means 14, and key cylinder 15.

The internal gear 12 operates the deadbolt assembly 11 enabling a deadbolt 11A to extend and retract into a door 30. The internal gear 12 is engaged by either the key cylinder 15 or by the childproofing means 14.

Figure 4:
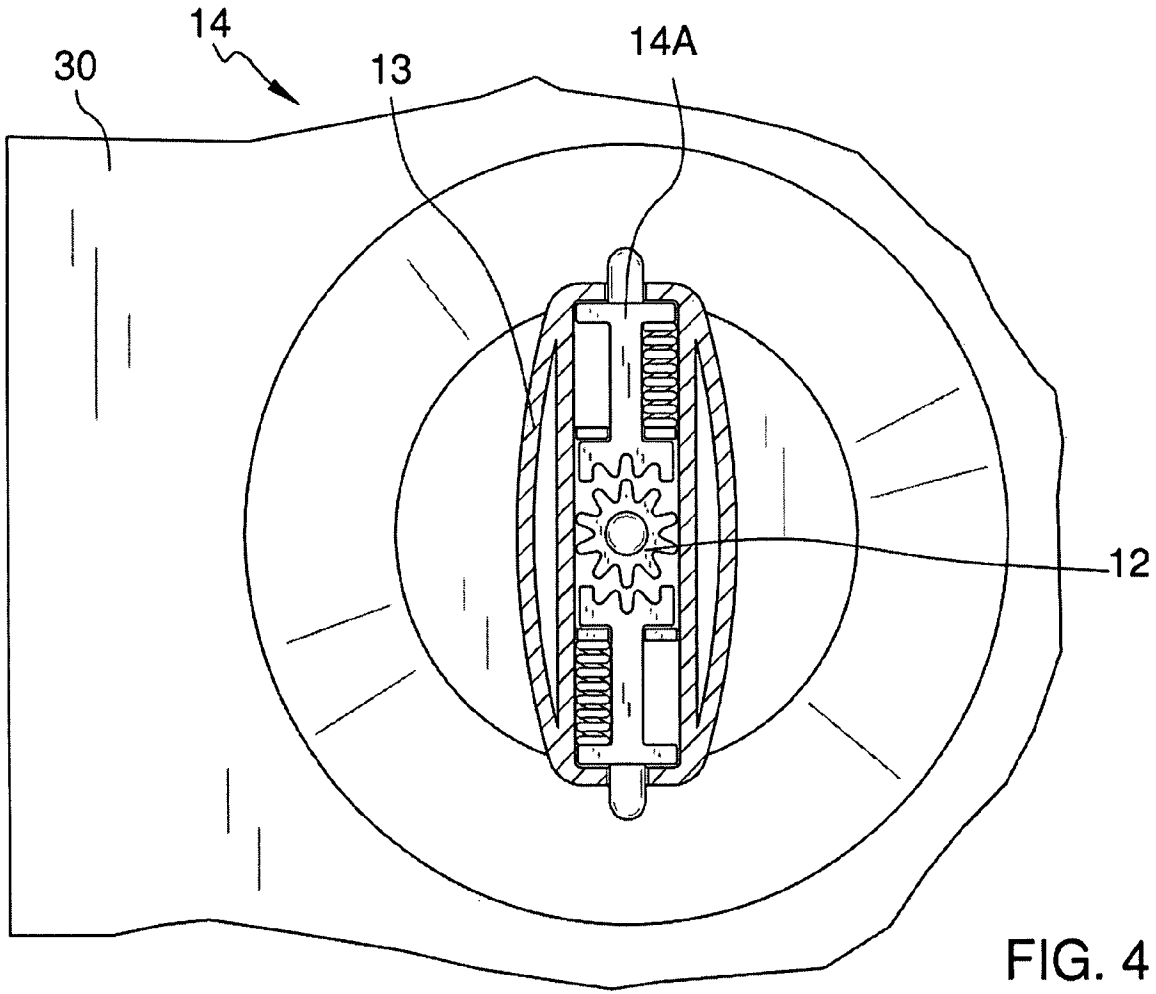
FIG. 4 illustrates a cross-sectional view of the childproof deadbolt along line 4-4 in FIG. 1.
Figure 5:
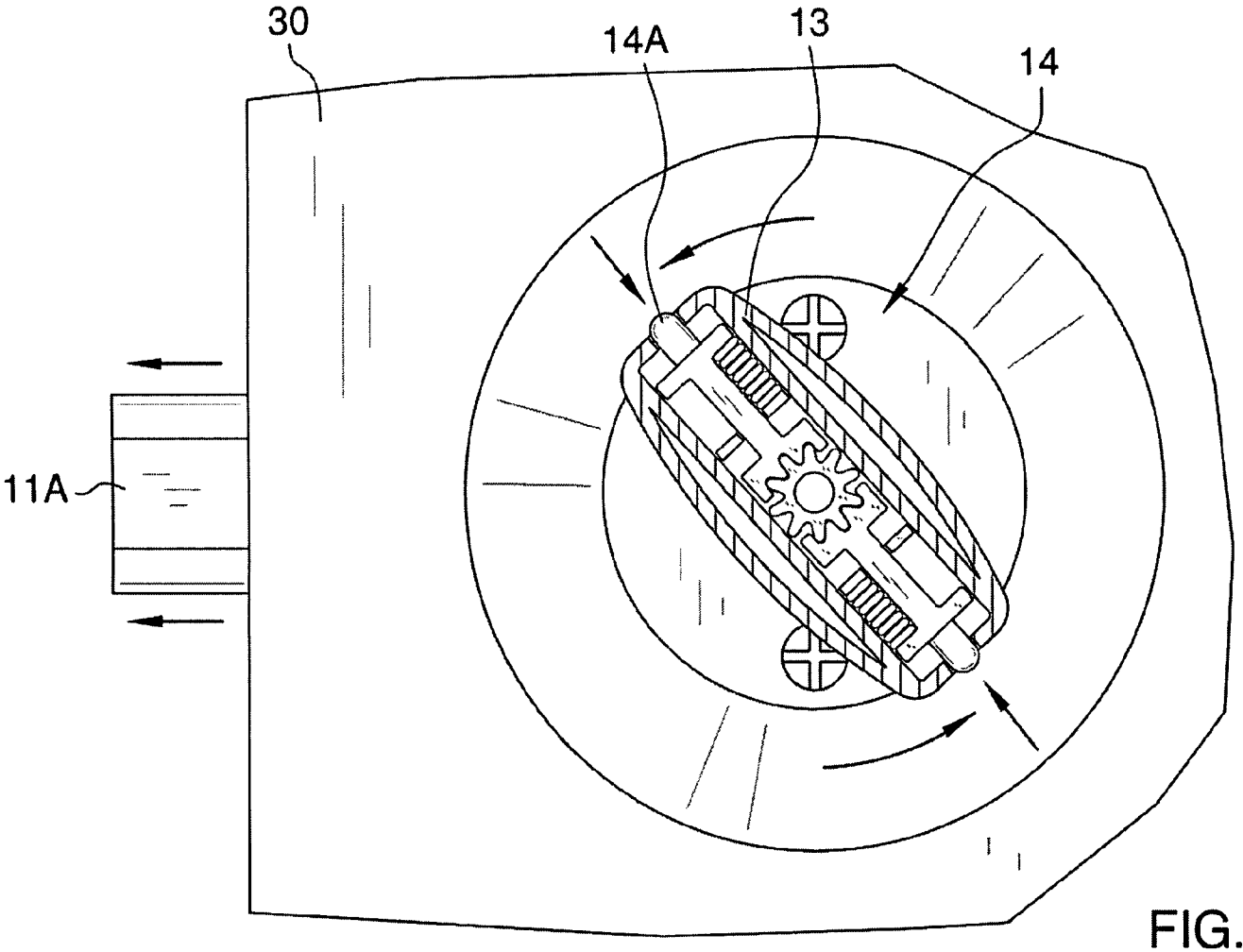
FIG. 5 illustrates a cross-sectional view of the childproof deadbolt along line 4-4 with the push buttons depressed and rotation of the thumb turn, internal gear, and deadbolt.
Figure 6:
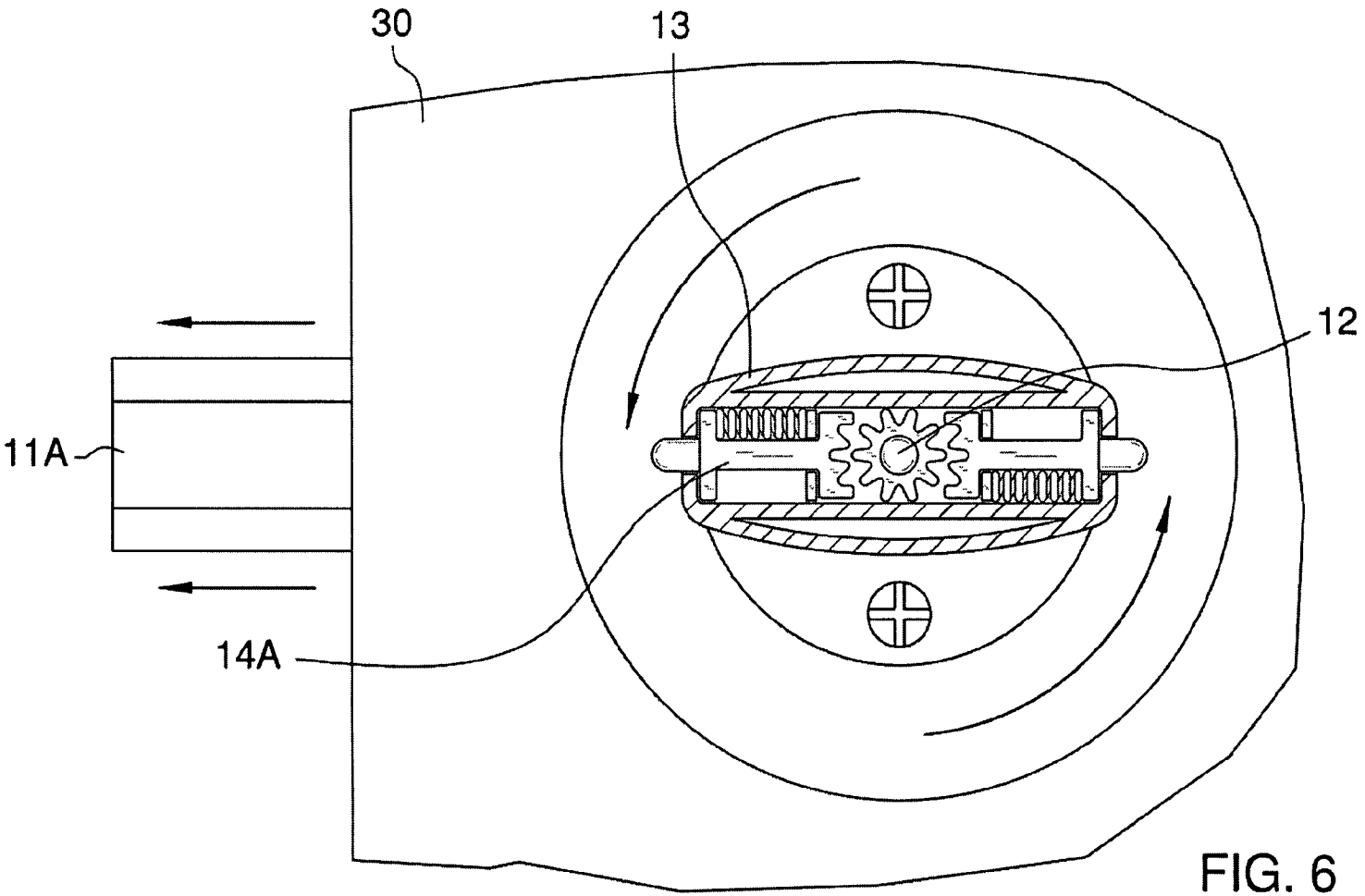
FIG. 6 illustrates a cross-sectional view of the childproof deadbolt along line 4-4 with the push buttons not depressed with the deadbolt extended.

The childproofing means 14 consists of at least one spring-loaded push button 14A (hereinafter push button) that is integrated into the design of the thumb turn 13, see FIGS. 1 and 4. The push button 14A in a normal state does not interact with the internal gear 12, but upon depression will engage and rotate the internal gear 12, which in turn operates the deadbolt assembly 11. Absent depression of the push button(s) 14A will enable the thumb turn 13 to rotate freely without operating the internal gear 12. The push button 14A has a bottom profile that contours to the teeth of the internal gear 12.

It shall be noted that the childproofing means 14, as depicted, includes two push buttons 14A that are each located along a first and second distal end of the thumb turn 13. The location and quantity of the push buttons 14A will directly dictate the level of "childproofing" of a deadbolt. Having a push button 14A on each distal end of the thumb turn 13 requires a hand of sufficient size and dexterity to depress both the push buttons 14A. The spring of the push buttons 14A will also dictate the level of "childproofing" of a deadbolt.

It shall be noted that the invention 10 may be constructed with no key cylinder 15. Additionally, the invention 10 may be constructed with a thumb turn 13 on each side of the door 30.

It shall be noted that the childproofing means 14 of the thumb turn 13 is the essence of the invention 10, and that the function and simplicity of the childproofing means 14 provides ample utility in preventing unwanted operation of the deadbolt 11A by a minor or person of limited dexterity or intellect.

Figure 7:
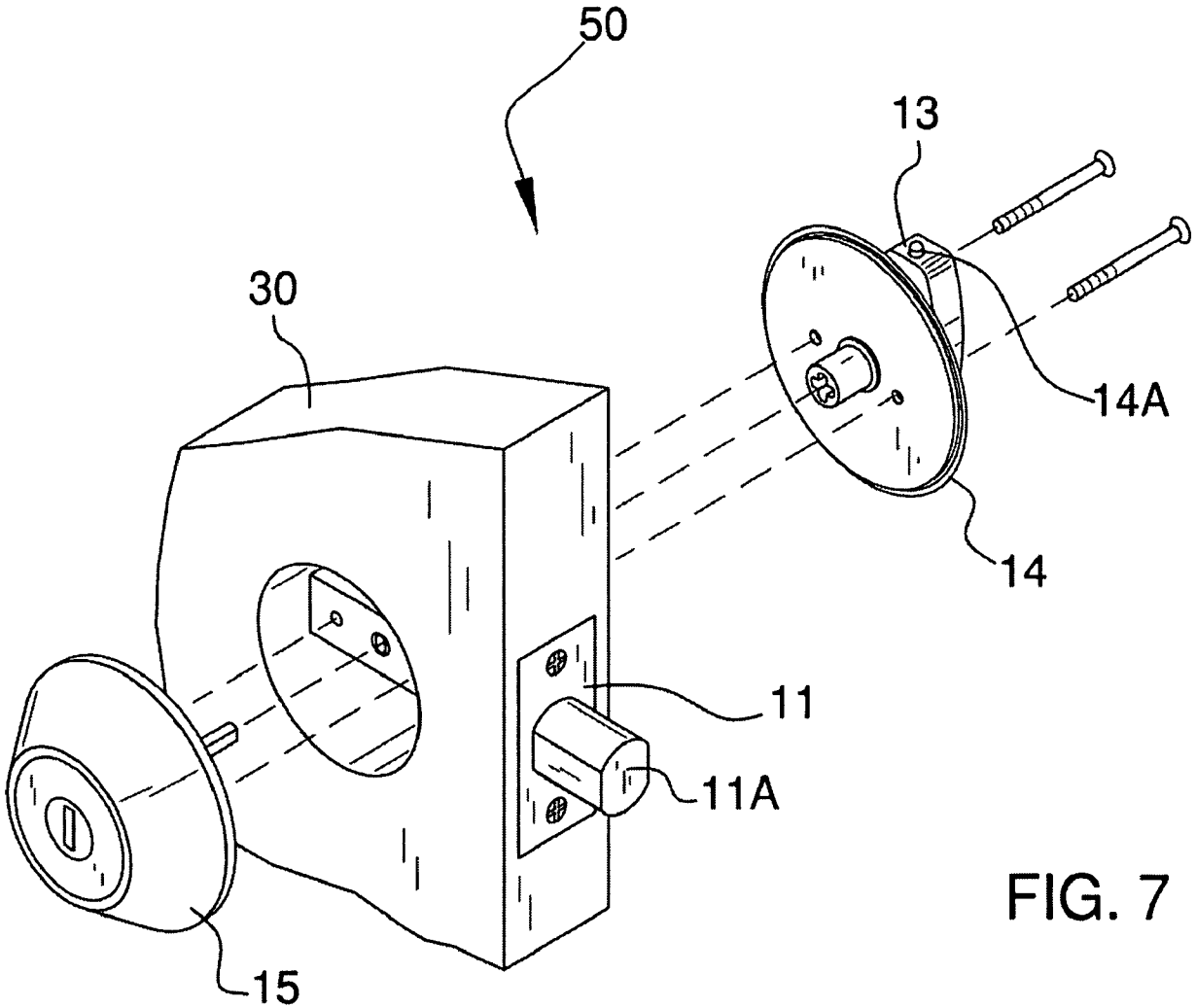
FIG. 7 illustrates a rear, exploded view of the various components of a residential version of the childproof deadbolt.

In referring to FIG. 7, a second embodiment 50 includes similar components as the invention 10, described above. The only difference in the second embodiment 50 is that the childproofing means 14 and internal gear are integrated into a single part. The overall objective and function of the second embodiment 50 mirrors that of the invention 10.

With respect to the above description, it is to be realized that the optimum dimensional relationship for the various components of the invention 10 and second embodiment 50, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10 and second embodiment 50.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A childproof deadbolt comprising:

a deadbolt assembly and an internal gear being in rotational contact with said deadbolt assembly;

a thumb turn is located upon a first side of said deadbolt assembly; wherein a childproofing means is integrated into the design of the thumb turn and engages said internal gear;

wherein the childproofing means are integrated internally within the thumb turn;

a key cylinder that is located upon a second side of said deadbolt assembly, and engages said internal gear.

2. The childproof deadbolt as described in claim 1 wherein the childproofing means consists of a spring-loaded push button on a first distal end of the thumb turn that in a normal state will not engage the internal gear; and upon depression of the push button, a bottom contour will engage teeth of the internal gear and thus operate the deadbolt assembly.

3. The childproof deadbolt as described in claim 1 wherein the childproofing means consists of a spring-loaded push button on a first distal end of the thumb turn and a second spring-loaded push button on a second distal end of the thumb turn;

in a normal state, both of the spring-loaded push buttons will not engage the internal gear; and upon depression of either of the push buttons, a bottom contour of either push buttons will engage teeth of the internal gear and thus operate the deadbolt assembly.

4. The childproof deadbolt as described in claim 1 wherein the thumb turn and internal gear are comprised of a single part.

5. A childproof deadbolt comprising:

(a) a deadbolt assembly;

(b) an internal gear;

wherein the internal gear is in rotational contact with the deadbolt assembly;

(c) a thumb turn;

wherein the thumb turn is located upon a first side of the deadbolt assembly;

wherein a childproofing means is integrated into the design of the thumb turn;

wherein the childproofing means are integrated internally within the thumb turn;

wherein the childproofing means engages the internal gear.

6. The childproof deadbolt as described in claim 5 wherein the childproofing means consists of a spring-loaded push button on a first distal end of the thumb turn that in a normal state will not engage the internal gear; and upon depression of the push button, a bottom contour will engage teeth of the internal gear and thus operate the deadbolt assembly.

7. The childproof deadbolt as described in claim 5 wherein the childproofing means consists of a spring-loaded push button on a first distal end of the thumb turn and a second spring-loaded push button on a second distal end of the thumb turn;

in a normal state, both of the spring-loaded push buttons will not engage the internal gear; and upon depression of either of the push buttons, a bottom contour of either push buttons will engage teeth of the internal gear and thus operate the deadbolt assembly.

8. The childproof deadbolt as described in claim 5 wherein the thumb turn and internal gear are comprised of a single part.

9. A childproof deadbolt comprising:

(a) a deadbolt assembly;

(b) an internal gear;

wherein the internal gear is in rotational contact with the deadbolt assembly;

(c) a thumb turn;

wherein the thumb turn is located upon a first side of the deadbolt assembly;

wherein a childproofing means is integrated into the design of the thumb turn;

wherein the childproofing means are integrated internally within the thumb turn;

wherein the childproofing means engages the internal gear;

(d) a second thumb turn;

wherein the second thumb turn is located upon a second side of the deadbolt assembly;

wherein childproofing means is integrated into the second thumb turn; and wherein the childproofing means engages the internal gear.

10. The childproof deadbolt as described in claim 9 wherein the childproofing means consists of a spring-loaded push button on a first distal end of the thumb turn that in a normal state will not engage the internal gear; and upon depression of the push button, a bottom contour will engage teeth of the internal gear and thus operate the deadbolt assembly.

11. The childproof deadbolt as described in claim 10 wherein the childproofing means consists of a spring-loaded push button on a first distal end of the thumb turn and a second spring-loaded push button on a second distal end of the thumb turn;

in a normal state, both of the spring-loaded push buttons will not engage the internal gear; and upon depression of either of the push buttons, a bottom contour of either push buttons will engage teeth of the internal gear and thus operate the deadbolt assembly.

12. The childproof deadbolt as described in claim 10 wherein the thumb turn and internal gear are comprised of a single part.

13. The childproof deadbolt as described in claim 10 wherein the second thumb turn and internal gear are comprised of a single part.

* * * * *